US006209525B1

(12) United States Patent
Konishi et al.

(10) Patent No.: US 6,209,525 B1
(45) Date of Patent: Apr. 3, 2001

(54) FUEL SUPPLY SYSTEM FOR DIRECT INJECTION GASOLINE ENGINE

(75) Inventors: Keiichi Konishi; Wakaki Miyaji; Masahiko Fujita, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/427,262

(22) Filed: Oct. 26, 1999

(30) Foreign Application Priority Data

Apr. 1, 1999 (JP) ..... 11-094741

(51) Int. Cl.[7] ..... F02M 37/04
(52) U.S. Cl. ..... 123/467; 123/511; 123/458
(58) Field of Search ..... 123/456, 467, 123/457, 458, 506, 446.7

(56) References Cited

U.S. PATENT DOCUMENTS

| | | | | |
|---|---|---|---|---|
| 4,562,816 | * | 1/1986 | Dorr | 123/456 |
| 4,615,320 | * | 10/1986 | Fehrenbach et al. | 123/467 |
| 5,195,487 | * | 3/1993 | Zurner et al. | 123/447 |
| 5,372,116 | * | 12/1994 | Davis | 123/467 |
| 5,478,213 | * | 12/1995 | Harris et al. | 123/506 |
| 5,505,181 | * | 4/1996 | Mcrea et al. | 123/510 |
| 5,526,790 | * | 6/1996 | Augustin et al. | 123/506 |
| 5,529,042 | * | 6/1996 | Augustin et al. | 123/506 |
| 5,535,724 | * | 7/1996 | Davis | 123/467 |
| 5,564,394 | * | 10/1996 | Wood | 123/506 |
| 5,575,262 | * | 11/1996 | Rohde | 123/467 |
| 5,752,486 | * | 5/1998 | Nakashima et al. | 123/467 |
| 5,832,904 | * | 11/1998 | Morishita et al. | 123/447 |
| 5,845,621 | * | 12/1998 | Robinson et al. | 123/456 |
| 5,884,607 | * | 3/1999 | Schiller et al. | 123/467 |
| 5,911,208 | * | 6/1999 | Furusawa et al. | 123/506 |
| 5,954,031 | * | 9/1999 | Ogiso et al. | 123/467 |
| 6,021,759 | * | 2/2000 | Okajima et al. | 123/467 |
| 6,053,712 | * | 4/2000 | Konishi et al. | 123/447 |

FOREIGN PATENT DOCUMENTS

| | | |
|---|---|---|
| 9-310661 | 12/1997 | (JP) . |
| 10-299609 | 11/1998 | (JP) . |

* cited by examiner

*Primary Examiner*—Thomas N. Moulis
(74) *Attorney, Agent, or Firm*—Sughrue, Mion Zinn, Macpeak & Seas, PLLC

(57) ABSTRACT

A fuel supply system for a direct injection gasoline engine can be used in a variable fuel pressure system without using a large pulsation absorber and, as a result, is inexpensive and can be easily reduced in size. The fuel supply system for a direct injection gasoline engine includes a single-cylinder high-pressure pump, a resonator for suppressing the pressure pulsation of high-pressure fuel supplied from the high-pressure fuel pump, and a high-pressure variable regulator for variably changing the pressure of the high-pressure fuel. The fuel-supply system directly injects the high-pressure fuel into the cylinders of the engine through injectors.

6 Claims, 10 Drawing Sheets

FUEL SUPPLY SYSTEM FOR DIRECT INJECTION GASOLINE ENGINE

FIELD OF THE INVENTION

The present invention relates to fuel supply equipment used in a variable fuel pressure system and, particularly, to fuel supply equipment for a direct injection gasoline engine, which comprises a single-cylinder high-pressure fuel pump and directly injects high-pressure fuel into the cylinders of an engine.

BACKGROUND OF THE INVENTION

Diesel engine technology is widely known as an example of an engine technology where the fuel is injected into its cylinders, which is so called "in-cylinder injection engine" or "direct injection engine". For spark ignition (gasoline) engine also, in-cylinder injection type has recently been proposed. For such in-cylinder injection engines, it is required that the fuel pressure pulsation should be small enough to achieve stable injection as well as the fuel injection pressure should be sufficiently high.

Therefore, a single-cylinder high-pressure fuel pump which is simple in structure, produced at a low cost and compact is already known.

Since the single-cylinder high-pressure fuel pump has only one plunger, it generates a larger pulsation width in the fuel pressure than a multi-cylinder high-pressure fuel pump does. Therefore, a metal bellows type or metal diaphragm type pulsation absorber is provided in a fuel supply system to absorb the pulsation.

FIG. 8 is a diagram showing the configuration of a fuel supply system for a direct injection gasoline engine disclosed by Japanese Laid-open Patent Application No. 9-310661, for example. In this fuel supply system for a direct injection gasoline engine, the pressure of fuel (gasoline) stored in a fuel tank 70 is increased to a low level by a low-pressure fuel pump 71 and then the fuel is supplied to a high-pressure fuel pump 73 by a low-pressure pipe 72. The high-pressure fuel pump 73 further increases the pressure of the fuel to a high level by the reciprocating motion of a plunger 75 driven by the cam shaft 74 of an unshown engine and discharges the fuel from an outlet port 76. This outlet port 76 is connected to a common rail 79 through a high-pressure check valve 77 and a high-pressure pipe 78. High-pressure fuel stored in the common rail 79 is supplied to injectors 81 attached to the respective cylinders 80 of the engine through branch passages 82.

This common rail 79 is connected to a metal bellows type pulsation absorber 85. This metal bellows type pulsation absorber 85 is constituted such that a barrel portion is composed of metal bellows 85*a,* an opening at one end of the metal bellows 85*a* is closed by an end plate 85*b,* a peripheral portion at the other end of the metal bellows 85*a* is connected to the end surface 85*c* of the absorber by welding or the like, a closed space is formed inside the metal bellows 85*a,* and gas such as nitrogen or argon is charged into this closed space. The pressure pulsation of high-pressure fuel to be applied to the end plate 85*b* is absorbed by the expansion and contraction of the metal bellows 85*a* so that the pressure pulsation of the high-pressure fuel supplied into the common rail 79 is absorbed.

FIG. 9 is a sectional view showing the configuration of a high-pressure fuel supply system 10D equipped with a metal diaphragm type pulsation absorber. The high-pressure fuel supply system 10D comprises a high-pressure fuel pump 11, a low-pressure damper 14 provided in an inlet passage 12 connected to an inlet port side of the high-pressure fuel pump 11 and equipped with metal bellows 14*a,* a high-pressure damper 90 provided in an outlet passage 15 connected to an outlet port side of the high-pressure fuel pump 11 and equipped with a metal diaphragm 90*m,* and a high-pressure check valve 17 arranged on a downstream side of the high-pressure damper 90, all of which are integrally arranged in a casing 100.

The high-pressure pump 11 pressurizes the low pressure fuel supplied from the unshown fuel inlet port through the inlet passage to a high pressure level and discharges it to the outlet passage 15 by utilizing the plunger 112 which is arranged in a cylinder 111 in such a manner it can reciprocate and is driven by a cam 19 whose rotational speed is a half of an unshown engine's crank speed.

The metal diaphragm type pulsation absorber 90 is provided to suppress the pressure pulsation of this discharged high-pressure fuel. As shown in FIG. 9 and FIG. 10, the metal diaphragm type pulsation absorber 90 comprises a case 91 constituting one part of a high-pressure container, a plate 92 constituting the other part of the high-pressure container, and a flexible thin metal disk-like diaphragm 90*m* forming a first high-pressure chamber 93 with the above case 91 and a second high-pressure chamber 94 with the above plate 92. The above second high pressure chamber 94 is connected via multiple through holes 96 with a recess 95 which constitutes a path between the first passage 15P to an outlet of the high-pressure fuel pump located in the casing 100 and the second passage 15Q to a check valve 17. The above first high-pressure chamber 93 is filled with unshown gas from a gas filling port 97 formed in the case 91 at a predetermined pressure. This predetermined pressure is required to absorb the pulsation of the high-pressure fuel running through the second passage portion 15Q from the first passage portion 15P through the recessed portion 95.

When pulsation occurs in the above fuel while the first high-pressure chamber 93 is filled with gas and the second high-pressure chamber 94 is filled with fuel, the diaphragm 90*m* absorbs the pressure pulsation by bending towards the case 91 and towards the plate 92 from the balance point (for example, a position having no deflection shown by a bold line in FIG. 10) where the total of the gas pressure in the first high-pressure chamber 93 and the spring force of the diaphragm 90*m* itself becomes equivalent to the average pressure of the fuel.

However, in the metal diaphragm type pulsation absorber 90, since the metal diaphragm which is an expansion member expands and contracts repeatedly by an amount equivalent to the pressure pulsation of fuel with the balance point at an average fuel pressure as a center, when this fuel supply system for a direct injection gasoline engine is used in a fuel pressure variable system, the balance point changes, whereby average stress generated in the diaphragm alters, thereby causing a problem with durability.

For instance, when the variable range of fuel supply pressure of the fuel supply system is 5 to 10 MPa and the balance point of the metal diaphragm 90*m* is set to $P_0$=7.5 MPa which is the center of the above variable range, as shown in FIG. 10, if $P_0$=10 MPa, the metal diaphragm 90*m* vibrates with the balance point greatly displaced to the first high-pressure chamber 93 side and if $P_0$=5 MPa, the metal diaphragm 90*m* vibrates with the balance point greatly displaced to the second high-pressure chamber 94 side. Since average stress applied to the metal diaphragm 90*m* becomes larger as the balance point displaces more from the center of the variable range, the durability of the metal diaphragm 90*m* deteriorates.

To prevent deterioration in the durability of the metal diaphragm, it is conceivable, for example, to reduce the volume of the first high-pressure chamber 93 so as to lessen the amount of charged gas. In this case, pulsation absorption capability becomes less. It is also possible to improve the durability of the metal diaphragm by reducing average stress to be applied to the metal diaphragm by increasing the diameter. However, in this case, the pulsation absorber becomes large in size.

Even when a metal bellows type pulsation absorber is used as a high-pressure damper, if fuel supply pressure is made variable, the gas charging pressure must be reduced to achieve the minimum fuel pressure and the number of pleats of the metal bellows must be increased to obtain the large expansion width of the metal bellows with the result that the system becomes large in size.

SUMMARY OF THE INVENTION

It is an object of the present invention which has been made in view of the above problems of the prior art to provide a fuel supply system for a direct injection gasoline engine which can be used in a fuel pressure variable system without using a large pulsation absorber, is inexpensive and can be reduced in size.

According to a first aspect of the present invention, there is provided a fuel supply system for a direct injection gasoline engine, which comprises a single-cylinder high-pressure fuel pump, a resonator for suppressing the pressure pulsation of high-pressure fuel supplied from the high-pressure fuel pump and a high-pressure variable regulator for controlling the pressure of high-pressure fuel, wherein the pressure of fuel to be injected into the cylinders of an engine from injectors is made variable, and the pressure pulsation of the fuel is suppressed.

According to a second aspect of the present invention, there is provided a fuel supply system for a direct injection gasoline engine, wherein the high-pressure variable regulator and the resonator are integrated with the high-pressure fuel pump.

The above and other objects, features and advantages of the invention will become more apparent from the following description when taken in conjunction with the accompanying drawings.

BRIEF DESCRIPTION OF THE ACCOMPANYING DRAWINGS

DETAILED DESCRIPTION OF THE PREFERRED EMBODIMENTS

Preferred embodiments of the present invention will be described with reference to the accompanying drawings.

Embodiment 1

Figure 1:
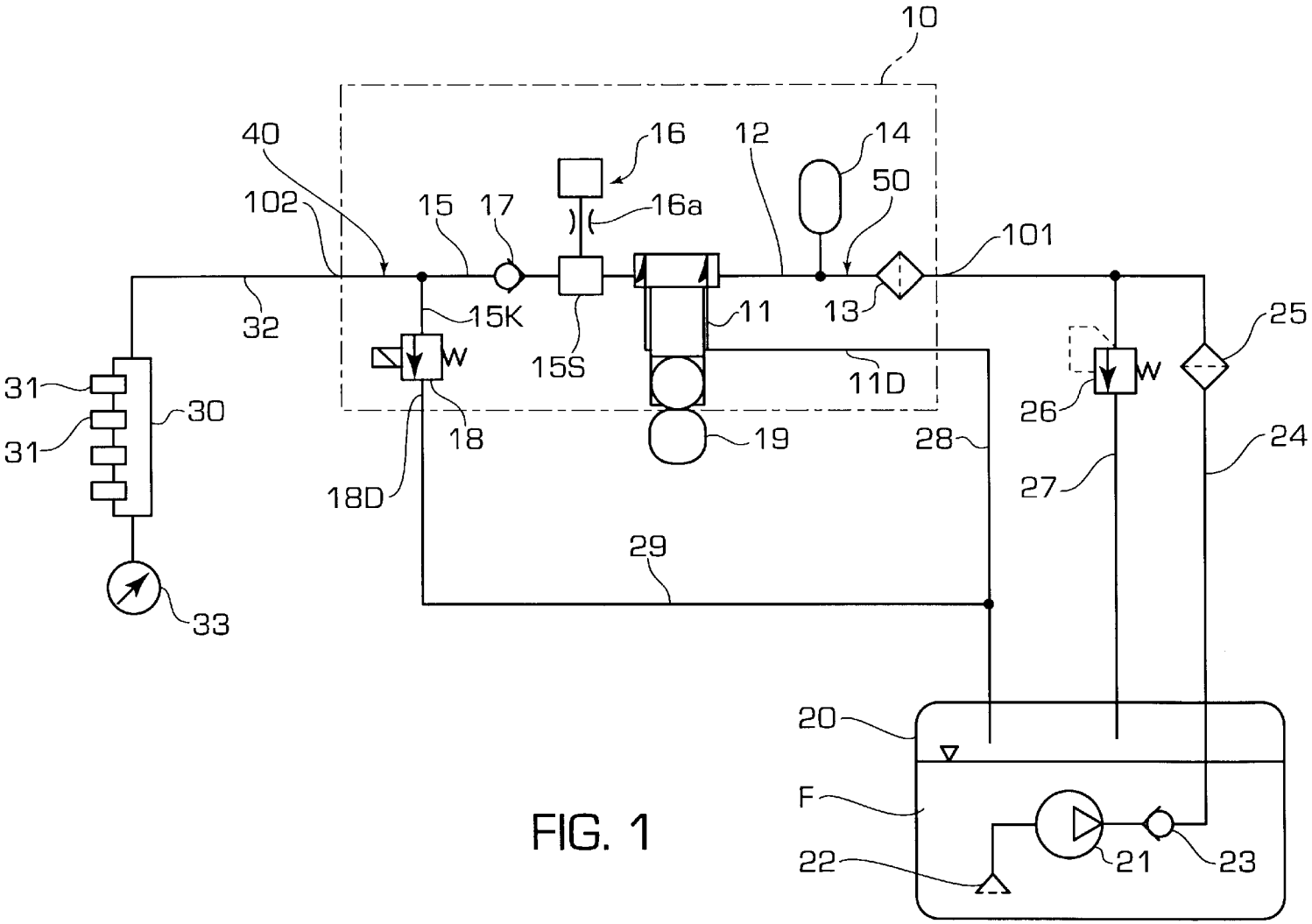
FIG. 1 is a diagram showing the configuration of a fuel supply system for a direct injection gasoline engine according to Embodiment 1 of the present invention.

FIG. 1 shows the configuration of a fuel supply system for a direct injection gasoline engine according to Embodiment 1 of the present invention. In FIG. 1, reference numeral 10 denotes a high-pressure fuel supplier equipped with a high-pressure fuel pump 11, 20 a fuel tank equipped with a low-pressure fuel pump 21, 30 a common rail storing the fuel supplied from the fuel tank 20 and pressurized by the high-pressure pump 11, 31 injectors attached to the respective cylinders of an unshown engine and connected to the common rail 30, 40 a high-pressure fuel passage for connecting the common rail 30 to the high-pressure fuel pump 11, and 50 a low-pressure fuel passage for connecting the high-pressure pump 11 to the fuel tank 20. The high-pressure fuel passage 40 and the low-pressure fuel passage 50 form a fuel passage for connecting the injectors 31 of the cylinders to the fuel tank 20. Letter F is fuel stored in the fuel tank 20.

Figure 2:
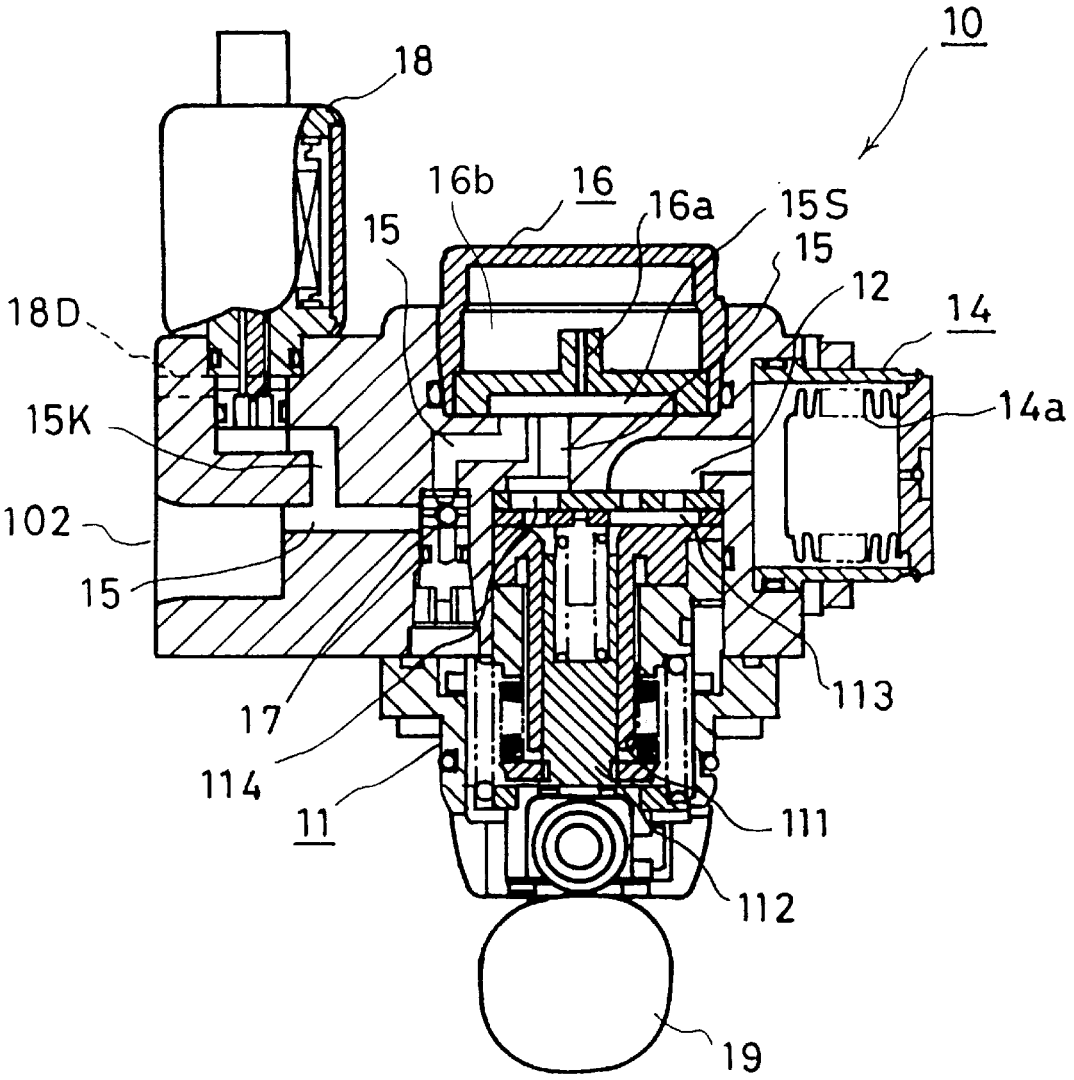
FIG. 2 is a sectional view of a high-pressure fuel supplier according to Embodiment 1 of the present invention.

As shown in FIG. 1 and FIG. 2, the high-pressure fuel supplier 10 comprises the high-pressure fuel pump 11, an inlet passage 12 constituting part of the low-pressure fuel passage 50 and connected to an inlet port side of the high-pressure fuel pump 11, a filter 13 arranged in the inlet passage 12, a low-pressure damper 14 provided between the high-pressure fuel pump 11 and the filter 13 and equipped with metal bellows 14*a*, an outlet passage 15 constituting part of the high-pressure fuel passage 40 and connected to an outlet port side of the high-pressure fuel pump 11, a resonator 16 which is a means of suppressing the pulsation of high-pressure fuel discharged from the high-pressure fuel pump 11 and communicates with a buffer chamber 15S provided in the outlet passage 15, a high-pressure check valve 17 arranged on a downstream side of the resonator 16 for maintaining the pressure of fuel in the common rail 30 to an appropriate level when the engine is suspended, a high-pressure variable regulator 18 arranged on a downstream side of the high-pressure check valve 17 for controlling the pressure of fuel to be supplied to the injectors 31 of the cylinders, a drain passage 18D for the high-pressure variable regulator 18 and a drain passage 11D for the high-pressure fuel pump 11.

The high-pressure pump 11 pressurizes the low pressure fuel supplied from the unshown fuel inlet port through the inlet passage to a high pressure level and discharges it to the outlet passage 15 by utilizing the plunger 112 which is arranged in a cylinder 111 in such a manner it can reciprocate and is driven by a cam 19 whose rotational speed is a half of an unshown engine's crank speed.

Denoted by 113 and 114 are reed valves for sucking and discharging fuel, respectively.

A filter 22 is provided on an inlet side of the low-pressure fuel pump 21 arranged in the fuel tank 20, and a low-pressure check valve 23 is provided on an outlet side of the low-pressure fuel pump 21. The outlet side of the low-pressure fuel pump 21 is connected to the fuel inlet port 101 of the high-pressure fuel supplier 10 by a low-pressure pipe 24. A filter 25 is provided in the low-pressure pipe 24. Reference numeral 26 denotes a low-pressure regulator provided on the low-pressure pipe 24, and 27 a low-pressure fuel return pipe for the low-pressure regulator. Reference numeral 28 represents a drain pipe for connecting the drain passage 11D of the high-pressure fuel pump 11 to the fuel tank 20, which is connected to a regulator drain pipe 29 for connecting the drain passage 18D of the high-pressure variable regulator 18 to the fuel tank 20.

Meanwhile, the fuel outlet port 102 of the high-pressure fuel supplier 10 and the common rail 30 are connected to each other by a high-pressure pipe 32. Denoted by 33 is a fuel pressure sensor provided on the common rail 30. A current to be applied to the coil of the above high-pressure variable regulator 18 is controlled by an unshown electronic control unit (ECU) based on the output signal of the fuel pressure sensor 33.

Figure 3:
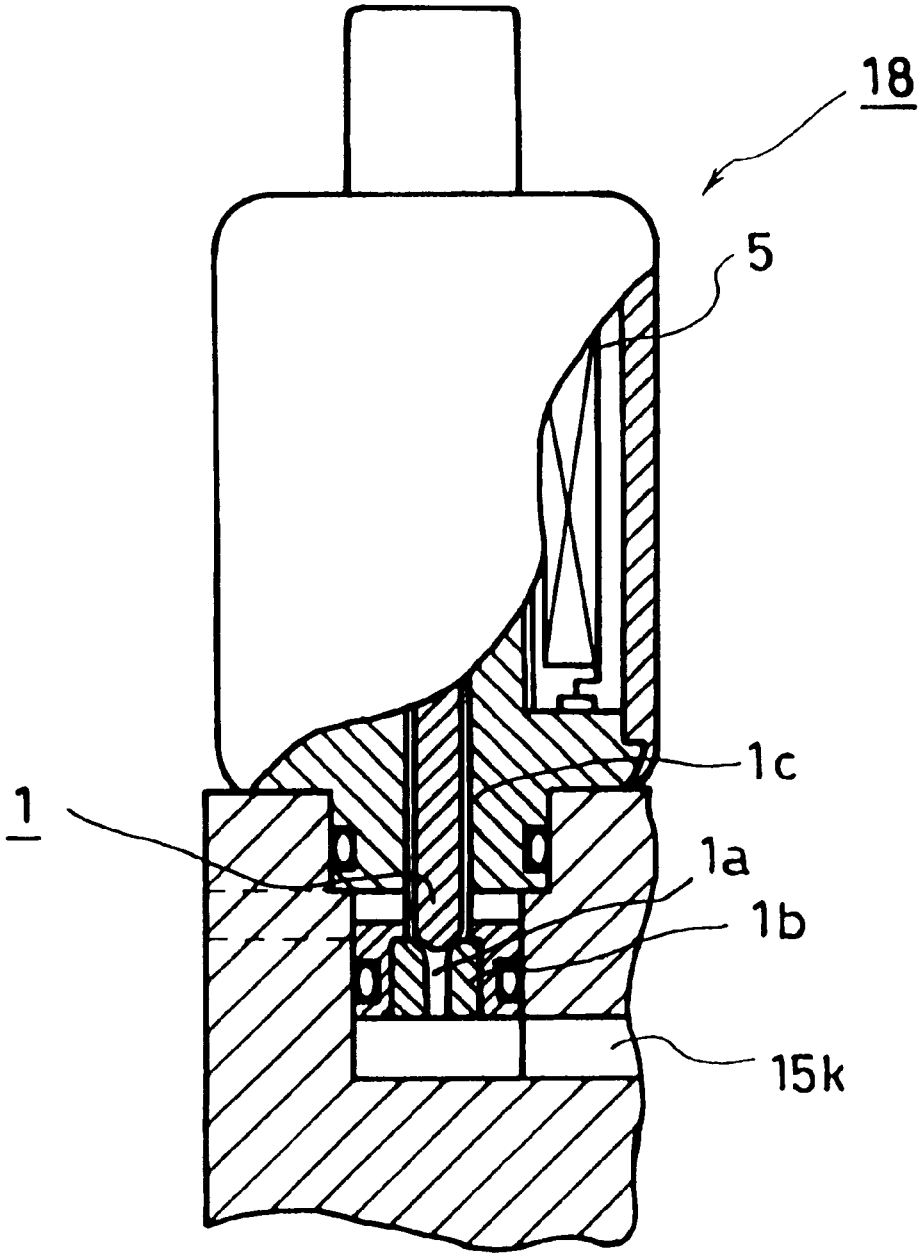
FIG. 3 is a diagram showing the configuration of a high-pressure variable regulator.

As shown in FIG. 3, the high-pressure variable regulator 18 for controlling the pressure of fuel comprises a needle valve 1 consisting of a valve sheet 1*b* having an orifice 1*a* which is opened to a branch passage 15K branching off from the outlet passage 15 and a needle 1*c* for opening and closing the orifice 1*a* by contacting to and separating from the valve sheet 1*b,* an unshown magnetic armature connected to the needle valve 1 integrally, an unshown spring for urging this armature downward (direction for closing the needle valve 1) and a coil 5 for generating a magnetic flux in a magnetic circuit comprising the armature and an unshown magnetic core, and controls the pressure of fuel discharged from the high-pressure fuel pump 11.

This high-pressure variable regulator 18 urges the needle valve 1 downward by the spring, changes the magnetic flux in the magnetic circuit comprising the magnetic core and the armature corresponding to the current applied to the coil 5 based on a required pressure of the fuel, assists the spring by controlling force for urging the armature downward and adjusts the opening of the needle valve 1. When the variable range of fuel supply pressure of the fuel supplier is 5 to 10 MPa, for example, a state having zero current applied to the coil 5 is a state where the needle valve 1 is opened most. At this point, the pressure of fuel becomes minimum at 5 MPa. When a current to be applied to the coil 5 is gradually increased, the needle valve 1 is gradually closed, and the pressure of fuel rises. When the supply current is maximum, fuel pressure is controlled to the maximum pressure of 10 MPa by urging the needle valve 1.

The high-pressure variable regulator may also be of such a type that sets the pressure of the spring to a level corresponding to the maximum pressure of fuel and controls the pressure of fuel by urging the armature upward by the coil 5.

The resonator 16 is a Helmholtz resonator comprising an orifice 16*a* which is opened to the buffer chamber 15S of the outlet passage 15 at one end and a fuel control chamber 16*b* connected to an opening portion at the other end of the orifice 16*a* (see FIG. 2). The amplitude of fuel pressure pulsation at the resonance frequency in the outlet passage 15 that is caused by the discharge pulsation of the high-pressure pump 11 can be reduced by controlling the resonance characteristics of the resonator 16 which are determined by the volume of the fuel control chamber 16*b* and the size of the orifice 16*a*.

The resonator 16 has a simple structure consisting of the orifice 16*a* and the fuel control chamber 16*b* and has no expansion member such as a metal diaphragm or metal bellows. Therefore, even when the range of variable fuel supply pressure of the fuel supplier is large, unlike the conventional pulsation absorber, a durability problem does not arise.

A description is subsequently given of the operation of the above fuel supply system for a direct injection gasoline engine. The low-pressure fuel pump 21 sucks fuel through the filter 22, increases the pressure of the fuel to a low level and discharges the fuel. This low-pressure fuel is supplied to the fuel inlet port 101 of the high-pressure fuel supplier 10 through the low-pressure check valve 23 and the filter 25 by the low-pressure pipe 24. At this point, when the pressure of the fuel running through the low-pressure pipe 24 exceeds a predetermined low value set by the low-pressure regulator 26, part of the fuel in the low-pressure pipe 24 is returned to the fuel tank 20 through the low-pressure regulator 26 by the low-pressure fuel return pipe 27, thereby controlling the pressure of fuel supplied to the high-pressure fuel supplier 10 from the fuel tank 20 to a predetermined value.

The fuel supplied to the inlet passage 12 of the high-pressure fuel supplier 10 is sucked by the high-pressure fuel pump 11 through the filter 13 and the low-pressure damper 14. The high-pressure fuel pump 11 increases the pressure of the above sucked fuel to a high level, discharges the fuel from the outlet passage 15 and drains fuel leaking from a space between the plunger 112 and the cylinder 111 of the high-pressure pump 11 to the drain passage 11D. The fuel flowing into the drain passage 11D is returned to the fuel tank 20 through the drain pipe 29.

The pulsation of the fuel supplied to the outlet passage 15 is suppressed by the resonator 16 in the buffer chamber 15S, and then the fuel passes through the high-pressure check valve 17 and is supplied to the common rail 30 from the fuel outlet port 102 through the high-pressure pipe 32. At this point, the pressure of the fuel running through the outlet passage 15 is controlled to a value set by the high-pressure variable regulator 18. When the pressure of the fuel exceeds the above set value, part of the fuel in the outlet passage 15 is returned to the fuel tank 20 by the drain passage 18D and the regulator drain pipe 29. In this state, the injectors 31 connected to the common rail 30 inject high-pressure fuel into the respective cylinders at a fuel injection timing for each cylinder of the engine.

According to this Embodiment 1, the pressure pulsation of high-pressure fuel discharged from the single-cylinder high-pressure fuel pump 11 is suppressed by the resonator 16, and the high-pressure variable regulator 18 for controlling the pressure of the high-pressure fuel is provided to control the pressure of high-pressure fuel to be supplied to the injectors 31 connected to the common rail 30. Therefore, a fuel pressure variable type fuel supply system for a direct injection gasoline engine which is small in size and has durability can be obtained.

Figure 4:
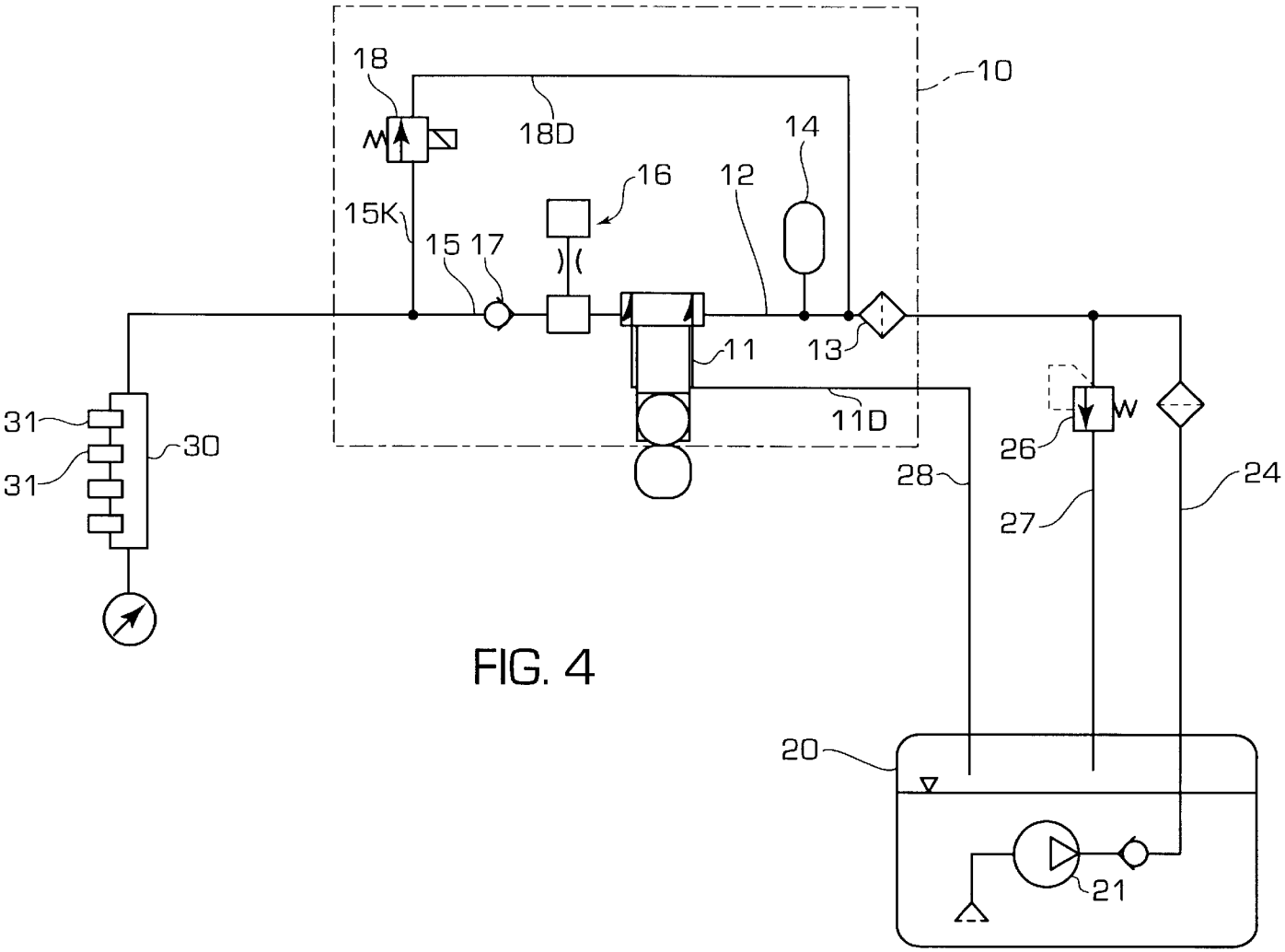
FIG. 4 is a diagram showing the configuration of another fuel supply system for a direct injection gasoline engine according to Embodiment 1 of the present invention.

In this Embodiment 1, when the pressure of fuel in the outlet passage 15 exceeds the above value set by the high-pressure variable regulator 18, part of the fuel in the outlet passage 15 (to be referred to as "regulator return" hereinafter) is returned to the fuel tank 20 by the drain passage 18D and the regulator drain pipe 29. As shown in FIG. 4, the drain passage 18D may be connected to the inlet passage 12 to return fuel to the inlet side of the high-pressure fuel pump 11.

Embodiment 2

Figure 5:
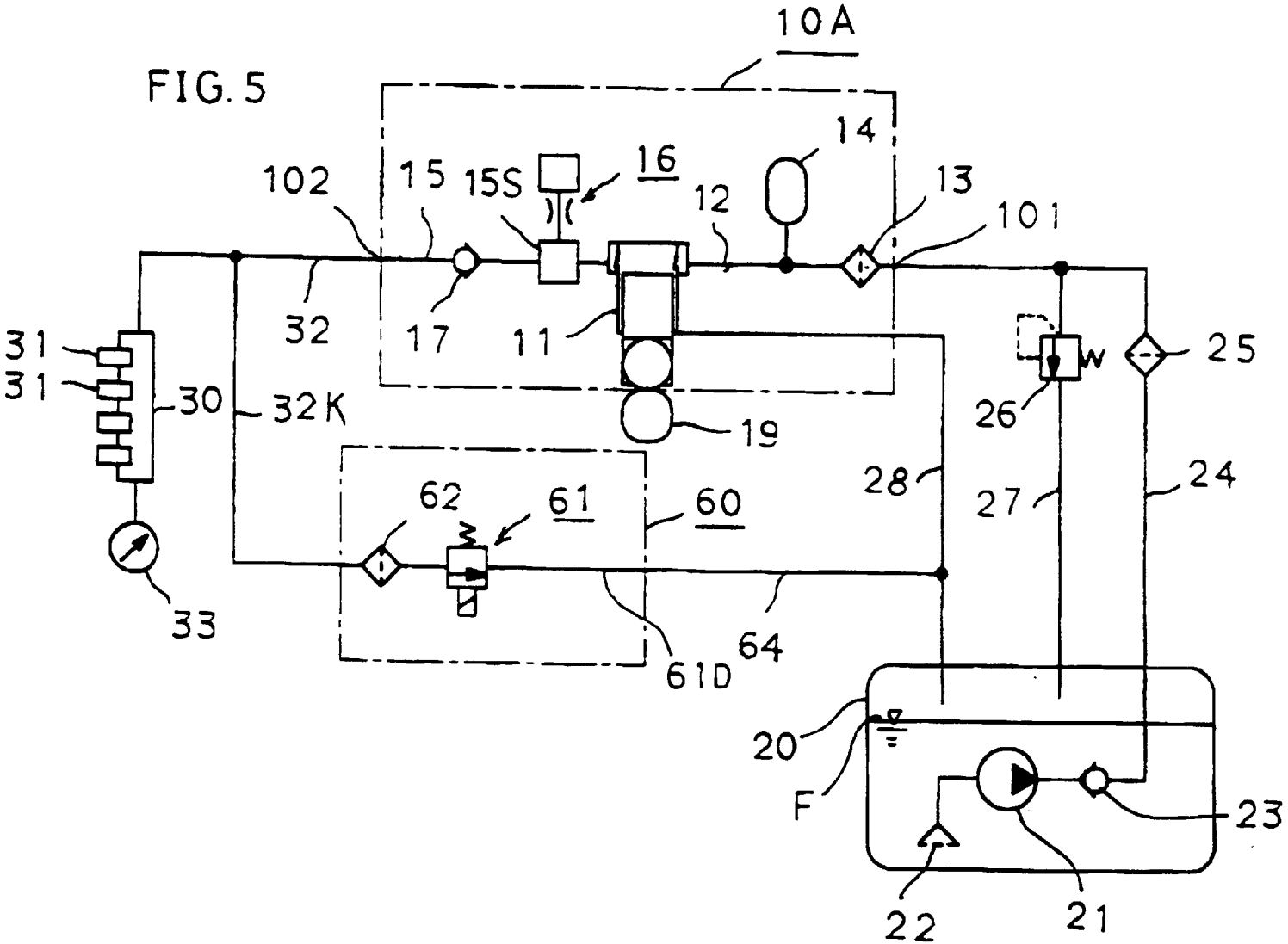
FIG. 5 is a diagram showing the configuration of a fuel supply system for a direct injection gasoline engine according to Embodiment 2 of the present invention.

FIG. 5 is a diagram showing the configuration of a fuel supply system for a direct injection gasoline engine according to Embodiment 2 of the present invention. The high-pressure variable regulator is constructed separately from the high-pressure fuel supplier. Reference numeral 60 denotes a regulator unit which is connected to the high-pressure pipe 32 for connecting the fuel outlet port 102 of a high-pressure fuel supplier 10A having no high-pressure variable regulator to the common rail 30 and comprises a high-pressure variable regulator 61 and a filter 62 provided on an upstream side of the high-pressure variable regulator 61. Denoted by 61D is a drain passage for the high-pressure variable regulator 61, and 64 a regulator drain pipe for returning regulator return to the fuel tank 20.

Figure 6:
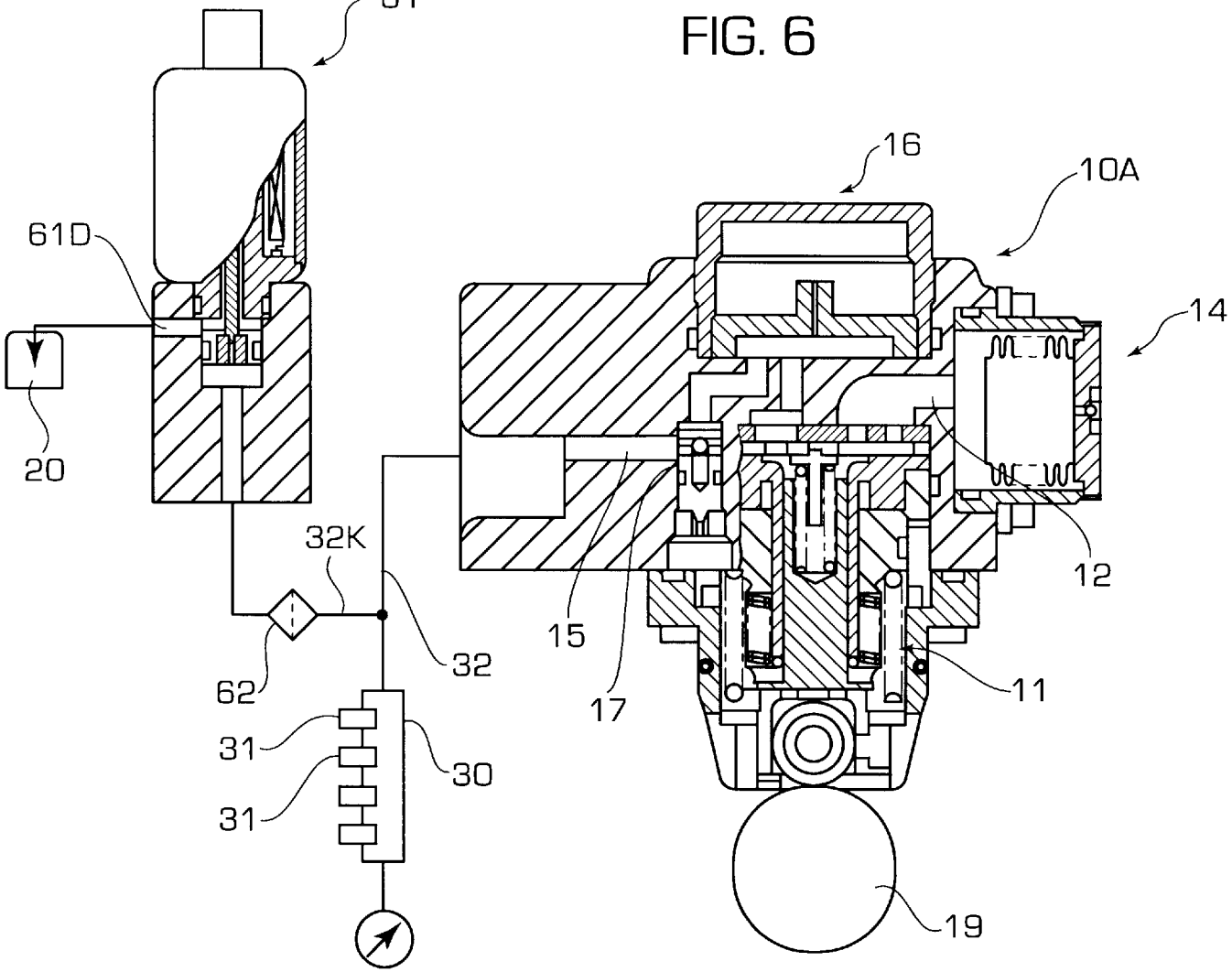
FIG. 6 is a sectional view of a high-pressure fuel supplier according to Embodiment 2 of the present invention.

FIG. 6 is a sectional view of the high-pressure fuel supplier 10A according to Embodiment 2 and diagram typically showing connection between the high-pressure fuel supplier 10A and the high-pressure variable regulator 61. The high-pressure fuel is supplied to the high-pressure pipe 32 from the fuel outlet port 102 of the high-pressure fuel supplier 10A, its pressure is controlled by the high-pressure variable regulator 61 provided in the high-pressure pipe 32, and the fuel is supplied to the common rail 30.

As the constituent elements of the high-pressure fuel supplier 10A and the high-pressure variable regulator 61 are the same as those of Embodiment 1 shown in FIG. 2 and FIG. 3, their descriptions are omitted, here.

Figure 7:
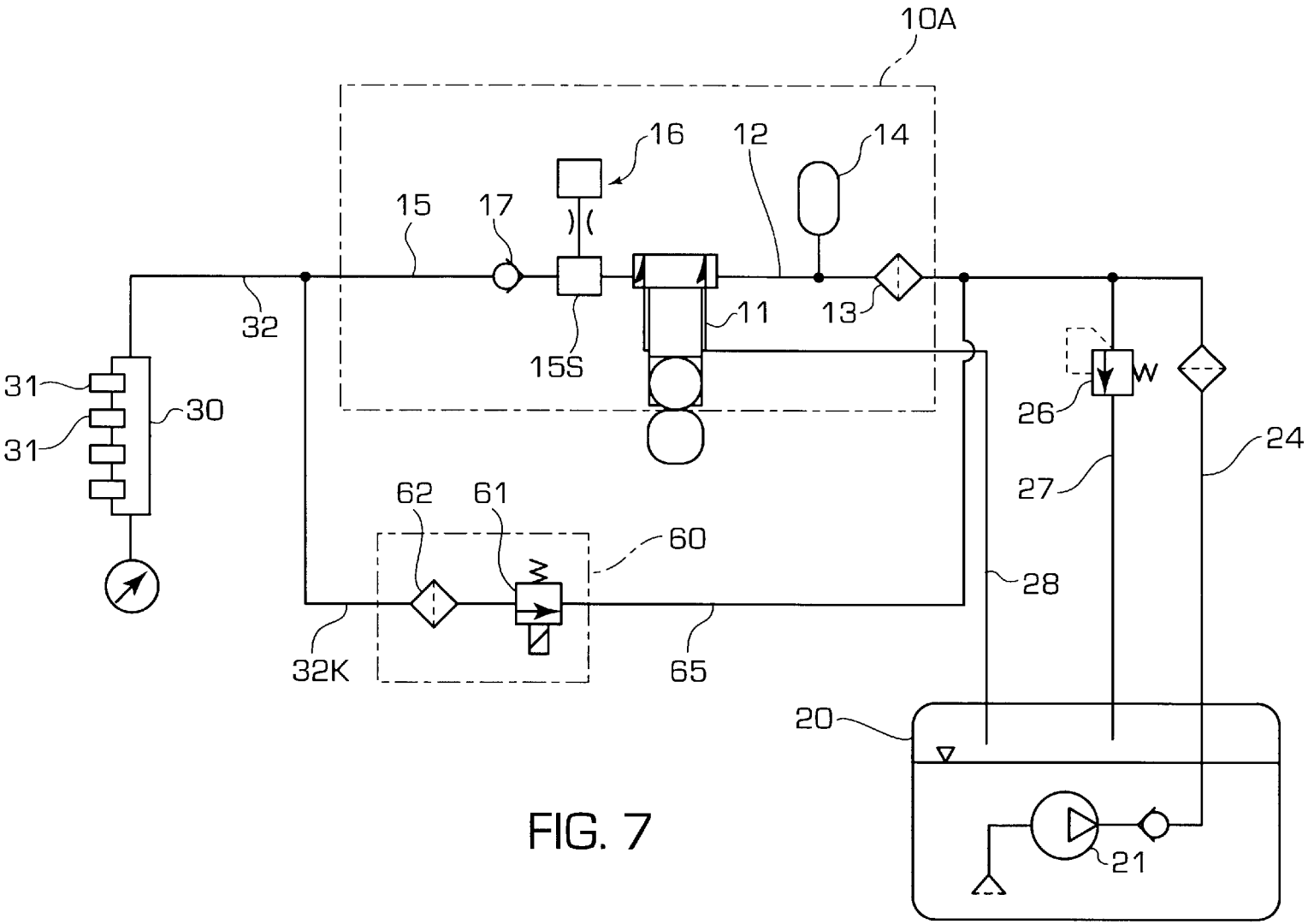
FIG. 7 is a diagram showing the configuration of another fuel supply system for a direct injection gasoline engine according to Embodiment 2 of the present invention.
Figure 8:
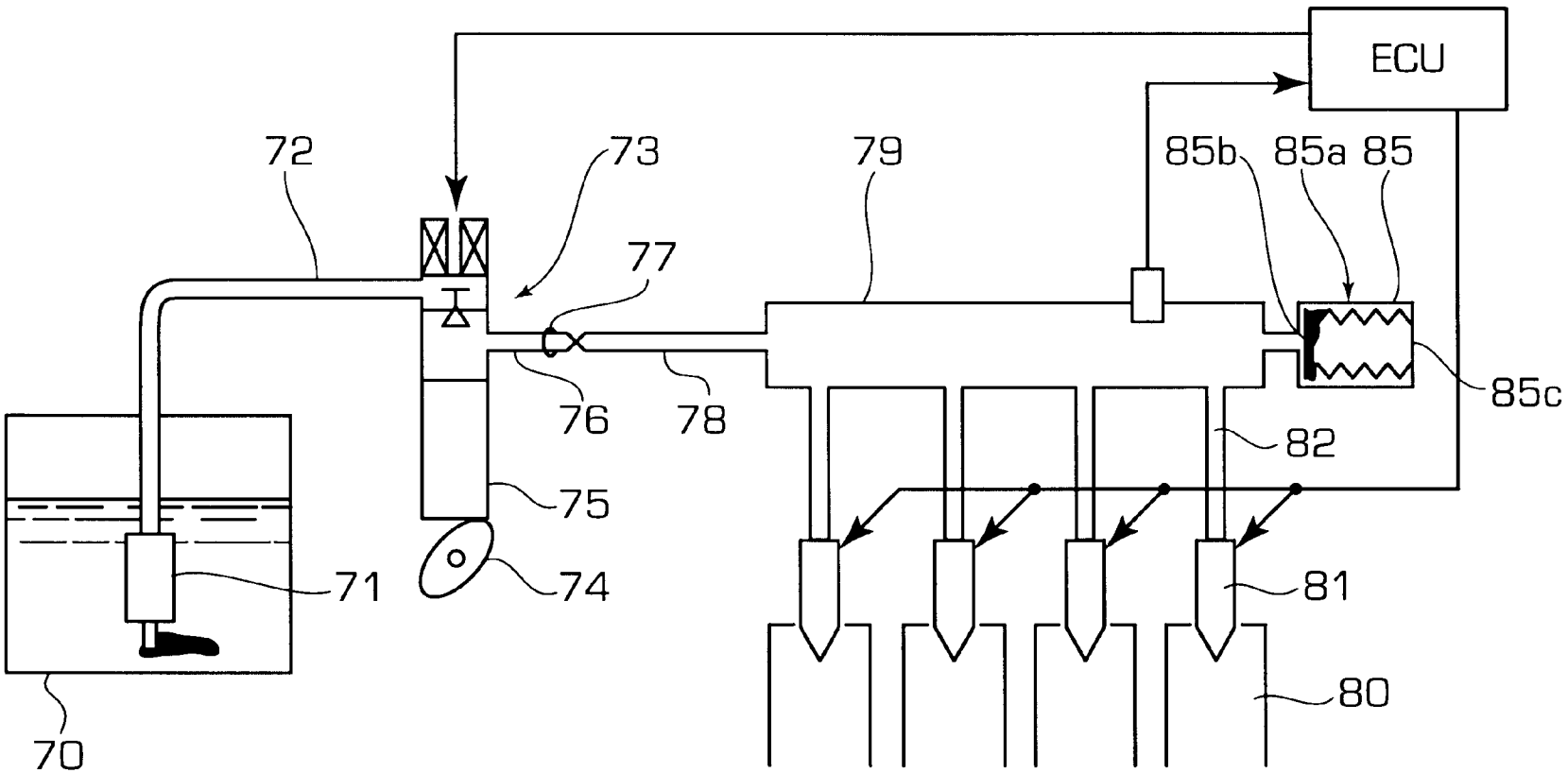
FIG. 8 PRIOR ART
FIG. 8 is a diagram showing the configuration of a fuel supply system for a direct injection gasoline engine of the prior art.
Figure 9:
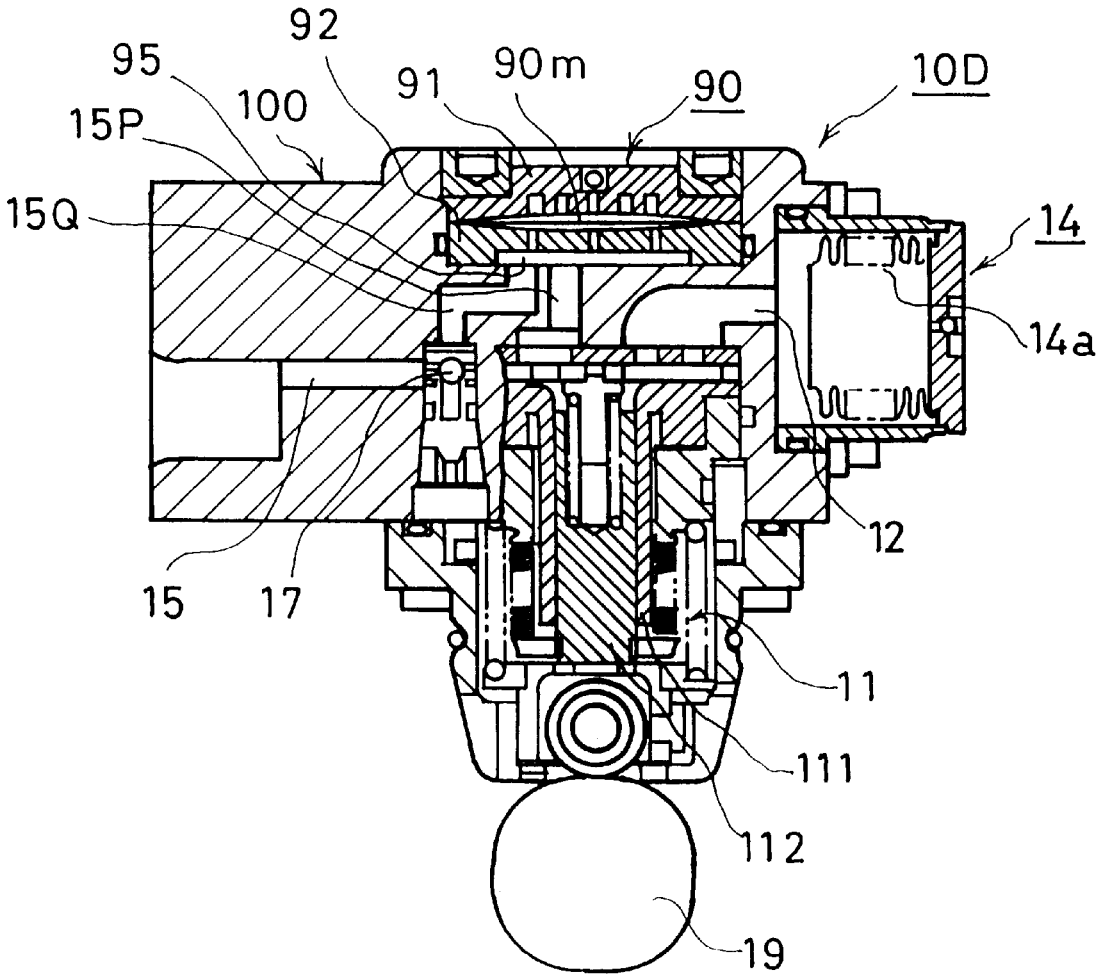
FIG. 9 PRIOR ART
FIG. 9 is a sectional view showing the configuration of another fuel supply system for a direct injection gasoline engine of the prior art.
Figure 10:
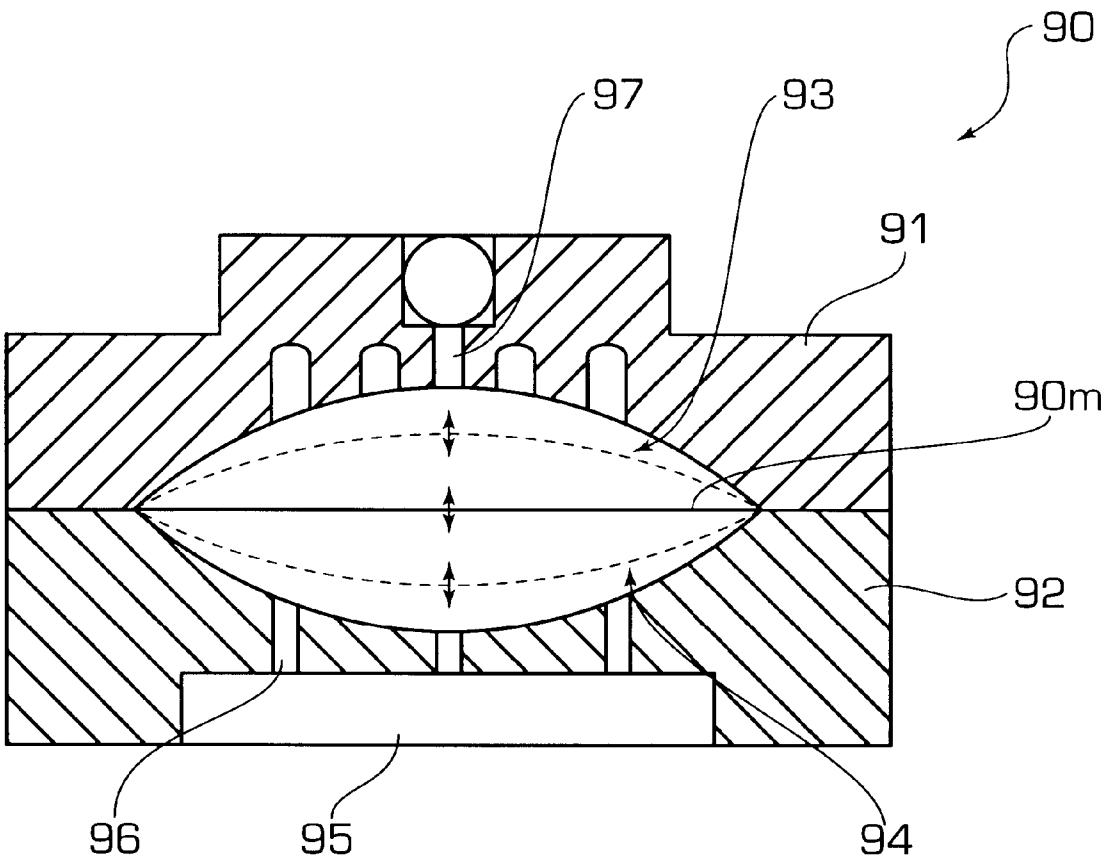
FIG. 10 is a diagram for explaining the operation of a pulsation absorber.

In this Embodiment 2, regulator return is returned to the fuel tank 20. As shown in FIG. 7, regulator return may be returned to the fuel inlet port 101 of the high-pressure fuel supplier 10A by a regulator drain pipe 65.

As having been described above, according to the first aspect of the present invention, a single-cylinder high-pressure fuel pump, a resonator for suppressing the pressure pulsation of high-pressure fuel supplied from the high-pressure fuel pump and a high-pressure variable regulator for controlling the pressure of the high-pressure fuel are provided, the pressure of fuel to be injected into the cylinders of the engine from the injectors can be changed, and the pressure pulsation of the fuel is suppressed. Therefore, a fuel pressure variable type fuel supply system for a direction injection gasoline engine which is small in size and has durability can be obtained.

According to the second aspect of the present invention, since the high-pressure variable regulator and the resonator are integrated with the high-pressure pump, the system can be further reduced in size.

What is claimed is:

1. A fuel supply system for a direct injection gasoline engine, comprising:

a single-cylinder high-pressure fuel pump that supplies high-pressure fuel;

a resonator for suppressing pressure pulsation of the high-pressure fuel supplied from the high-pressure fuel pump; and a high-pressure variable regulator for variably changing the pressure of the high-pressure fuel supplied by the high-pressure fuel pump, wherein the system outputs variably regulated high-pressure fuel for being directly injected into cylinders of the engine.

2. The fuel supply system for a direct injection gasoline engine according to claim 1, wherein the high-pressure variable regulator and the resonator are integrated with the high-pressure fuel pump.

3. The fuel supply system for a direct injection gasoline engine according to claim 1, further comprising a high-pressure check valve disposed between the high-pressure fuel pump and the high-pressure variable regulator.

4. The fuel supply system for a direct injection gasoline engine according to claim 1, further comprising a low-pressure fuel pump for supplying low-pressure fuel to an inlet of the high-pressure fuel pump.

5. The fuel supply system for a direct injection gasoline engine according to claim 1, wherein the high-pressure variable regulator is electrically-controllable for effecting the variable changing of pressure.

6. The fuel supply system for a direct injection gasoline engine according to claim 5, further comprising an electrical control unit (ECU) operative to provide electrical control of the high-pressure variable regulator.

* * * * *